US008943729B2

(12) United States Patent
Williams

(10) Patent No.: US 8,943,729 B2
(45) Date of Patent: Feb. 3, 2015

(54) HANDGUN MOUNT FOR FOREARM STOCK OF LONG GUN

(75) Inventor: Rick Williams, Springfield, MO (US)

(73) Assignee: Williams Company Enterprises, LLC, Springfield, MO (US)

( * ) Notice: Subject to any disclaimer, the term of this patent is extended or adjusted under 35 U.S.C. 154(b) by 391 days.

(21) Appl. No.: 13/050,559

(22) Filed: Mar. 17, 2011

(65) Prior Publication Data

US 2011/0225865 A1 Sep. 22, 2011

Related U.S. Application Data

(60) Provisional application No. 61/314,851, filed on Mar. 17, 2010.

(51) Int. Cl.
*F41C 23/16* (2006.01)
*F41C 7/02* (2006.01)

(52) U.S. Cl.
CPC .. *F41C 23/16* (2013.01); *F41C 7/02* (2013.01)
USPC ..... 42/90; 42/72; 42/106

(58) Field of Classification Search
USPC ..... 42/71.01, 71.02, 72, 90, 106, 85
See application file for complete search history.

(56) References Cited

U.S. PATENT DOCUMENTS

| | | | | |
|---|---|---|---|---|
| 511,940 | A * | 1/1894 | Fairbanks | 42/106 |
| 2,826,848 | A | 3/1958 | Davies | |
| 4,021,954 | A * | 5/1977 | Crawford | 42/127 |
| 4,291,482 | A * | 9/1981 | Bresan | 42/72 |
| 4,321,765 | A * | 3/1982 | Gillum | 42/72 |
| 5,027,542 | A | 7/1991 | Simonetti | |
| 5,107,612 | A * | 4/1992 | Bechtel | 42/115 |
| 6,655,069 | B2 * | 12/2003 | Kim | 42/114 |
| 2009/0193702 | A1 * | 8/2009 | Lin | 42/72 |

OTHER PUBLICATIONS

Uta17—UTA (Universal Tactical Attachment) http://web.archive.org/web/20061124012517/http:/www.thecountryshed.com/glock$_{13}$ accessories.htm Dated Nov. 24, 2006.*

* cited by examiner

*Primary Examiner* — Daniel J Troy
(74) *Attorney, Agent, or Firm* — Lathrop & Gage LLP

(57) ABSTRACT

A handgun mount is described for attaching a handgun to the forend of a long gun. A pump action of the long gun, if required for operation, may be actuated by moving the handgun along the forend of the long gun, and the handgun may be fired by the user of the long gun simultaneously with operation of the long gun.

7 Claims, 13 Drawing Sheets

HANDGUN MOUNT FOR FOREARM STOCK OF LONG GUN

CROSS-REFERENCE TO RELATED APPLICATIONS

This is a non-provisional application which claims priority of U.S. Provisional Patent Application No. 61/314,851 filed on Mar. 17, 2010, which application is incorporated herein by reference.

BACKGROUND

1. Field of the Invention

The handgun mount for the forearm stock of a long gun is in the field of accessories and mounts for firearms.

2. Description of the Related Art

Other mounts for handguns have been described including mounts for laser sights, scopes or other accessories. A pistol grip for a forend stock has been described in U.S. Pat. No. 2,926,848. However no mounts have been disclosed to mount a handgun to the forend of a long gun and allow the user to actuate the pump action while firing the handgun and the long gun simultaneously without moving either hand or repositioning the firearm.

SUMMARY OF THE INVENTION

The handgun mount comprises a mounting rail attached to the forend of a long gun. A handgun bracket is releasably mounted to the mounting rail, and a handgun is releasably attached to the handgun bracket. If the long gun has a pump action, it may be actuated by moving the handgun back and forth along the forend of the long gun. This allows the user of the handgun mount to fire both the long gun and the handgun simultaneously without moving either hand or repositioning either weapon.

BRIEF DESCRIPTION OF THE DRAWINGS

FIG. 6 is a cross-sectional view of a portion of an embodiment of the handgun mount.

DETAILED DESCRIPTION

In tactical situations, law enforcement or military personnel have very limited time to reload, exchange weapons or otherwise rearm to adjust to the changing threats with which they are confronted. The amount of firepower that they can bring to bear in a situation may greatly affect the outcome of the situation. Therefore, it is desirable to provide a means for such personnel to carry two firearms into a tactical situation with both firearms ready for instant use by their user, without the need of changing the user's hand position or requiring that the user draw a weapon from a holster.

The handgun mount described herein provides a mount attached to the forearm stock area of a long gun for supporting a handgun. The handgun is secured underneath the barrel of the long gun so that the barrel of the handgun points in substantially the same direction as the barrel of the long gun. The handgun mount allows a user to hold and operate the long gun as it is typically operated with one hand, while simultaneously supporting the long gun and having a handgun in the other hand ready to be fired. A long gun includes any and all types and variations of rifles, shotguns, or similar types of guns.

The user of the handgun mount supports the long gun by gripping the trigger area of the long gun in one hand as usual. The user's other hand, which would normally grip the forearm stock of the long gun, holds the grip of the handgun during use of the long gun. The user can then simultaneously aim both the long gun and the handgun by moving the hand holding the handgun grip. The user can also selectively fire either firearm by pulling the appropriate trigger. Since the users hands are on both firearms which point in the same direction, the action of selecting which gun to fire does not require any re-aiming of the gun or re-positioning of hands.

In some embodiments of the handgun mount, it is mounted to the forearm stock of a pump action long gun. In these embodiments, the handgun mount is attached to the forend tube assembly and the pump action of the gun is actuated by moving the handgun, and the attached handgun mount forward and backward along the barrel or magazine of the long gun. This configuration allows the user to actuate the pump action gun, ejecting a shell and loading a new shell into the chamber without removing the hand from the handgun mounted under the barrel of the long gun.

Figure 1:
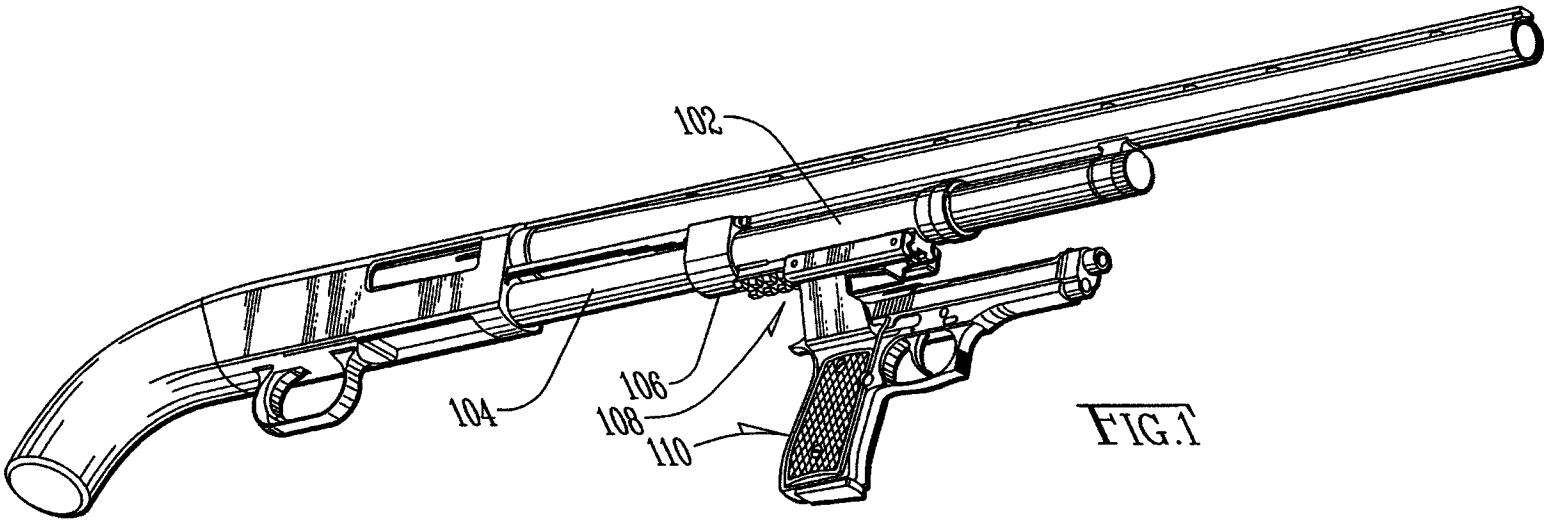
FIG. 1 is a perspective view of a long gun with an embodiment of the handgun mount attached thereto.

Referring now to FIG. 1, a perspective view of a long gun with an embodiment of the handgun mount attached thereto is depicted. The long gun shown in the figure is a pump action shotgun, however other types of long guns could also utilize embodiments of the handgun mount similar to those depicted in the following figures. The gun has a forearm stock, or forend, 102 that provides a user of the gun with a comfortable grip for holding the gun, and for pointing the gun in the desired direction during use. The long gun may or may not have a magazine tube disposed beneath the barrel of the gun.

In the case of a pump action gun, the forend allows a user to eject spent shells and load new shells from magazine tube 104 which holds shells to be loaded into the receiver as the pump action is actuated by the user of the gun. The forend 102 is mounted on a forend tube assembly 106 which is slidably retained on the magazine tube 104. The act of sliding the forend 102 backwards and then forwards actuates the pump action, ejecting a shell and loading a new shell into the chamber. As manufactured, the forend tube assembly 106 is disposed within or supports a grip allowing the user to easily grasp and operate the forend tube assembly 106. In FIG. 1, the grip has been removed and replaced with a handgun mount assembly 108 as described herein. A handgun 110 has been mounted in the handgun mount assembly 108 for use by the operator of the firearm.

Figure 2:
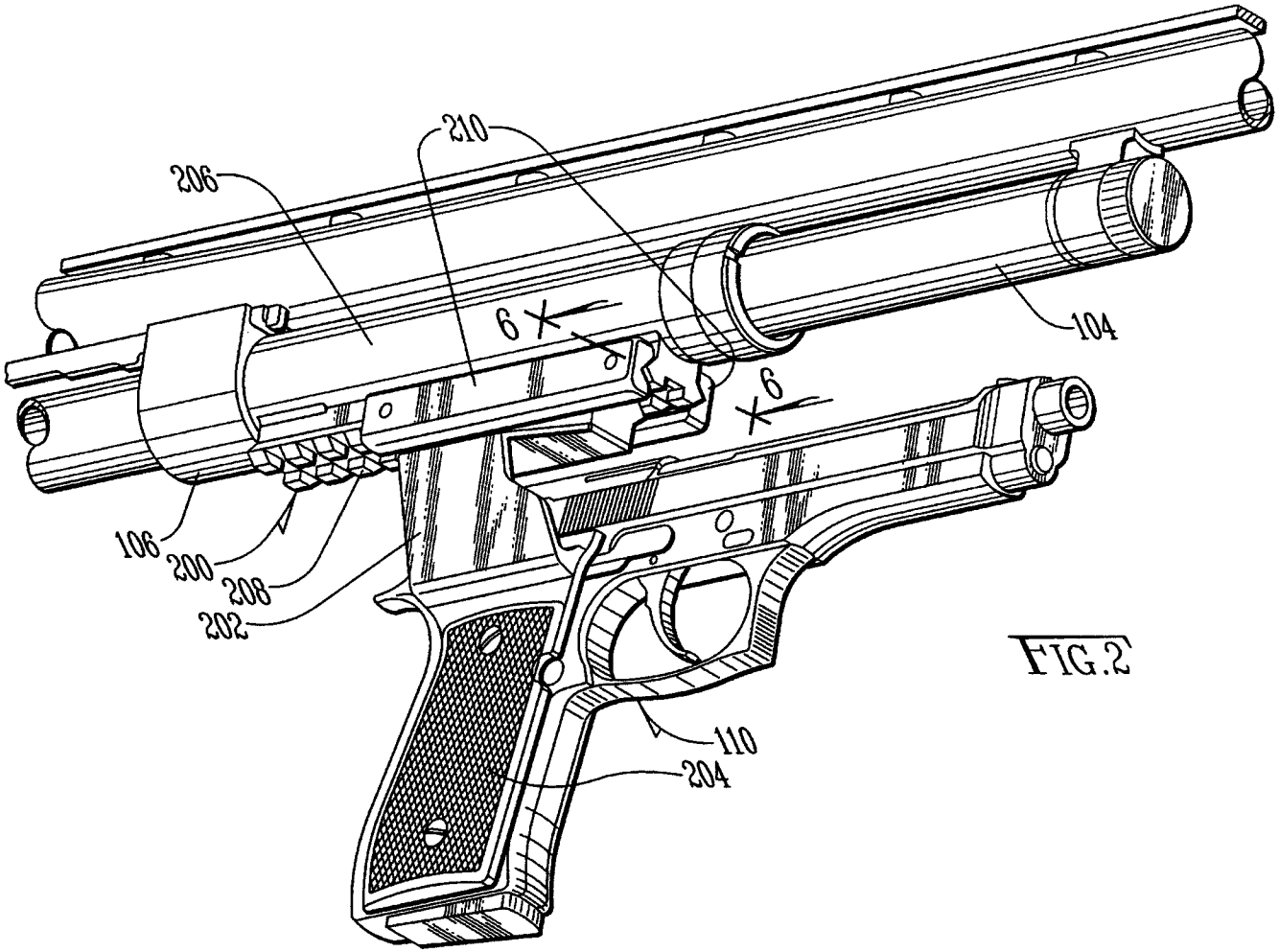
FIG. 2 is a detail perspective view of a long gun with an embodiment of the handgun mount attached thereto.

Referring now to FIG. 2, a detail side view of a pump action gun incorporating an embodiment of the handgun mount is depicted. The forend grip has been removed from the forend tube assembly. In its place a long gun mount assembly 200 has been attached to the forend tube assembly 106. The mount assembly 200 may be permanently attached to the forend tube assembly or barrel by welding, or alternatively may be removably attached or retainer thereto by screws, bolts, nuts or other retaining mechanism.

A handgun bracket 202 is removably attached to a handgun 110. In FIG. 2, the handgun bracket 202 is attached to the handgun 110 at grip 204 by screws or bolts. The handgun bracket 202 is part of the handgun mount assembly, described below, which is also removably and adjustably attached to long gun mount assembly 200. The releasable connection between the mount assembly 200 and the handgun mount assembly provides a secure connection for the user operating the pump action. Mount assembly 200 comprises tube 206 and rail mount 208. Rail mount 208 may be welded to tube 206, or attached thereto by screws or bolts, or other means of attachment.

Rail mount 208 is provided with various geometric features for interlocking with the handgun mount assembly and securing it in place. In some embodiments, the rail 208 may be of the type of rail mount commonly known as "Picatinny rails" such as rail "MIL-STD-1913" which is used on a variety of military weapon systems for attaching accessories to the weapon. As will be described more clearly in relation to later figures, handgun mount assembly incorporates the handgun bracket 202 and a rail that interlocks with rail 208 and is locked in place by brackets, or clamps, 210.

Figure 3:
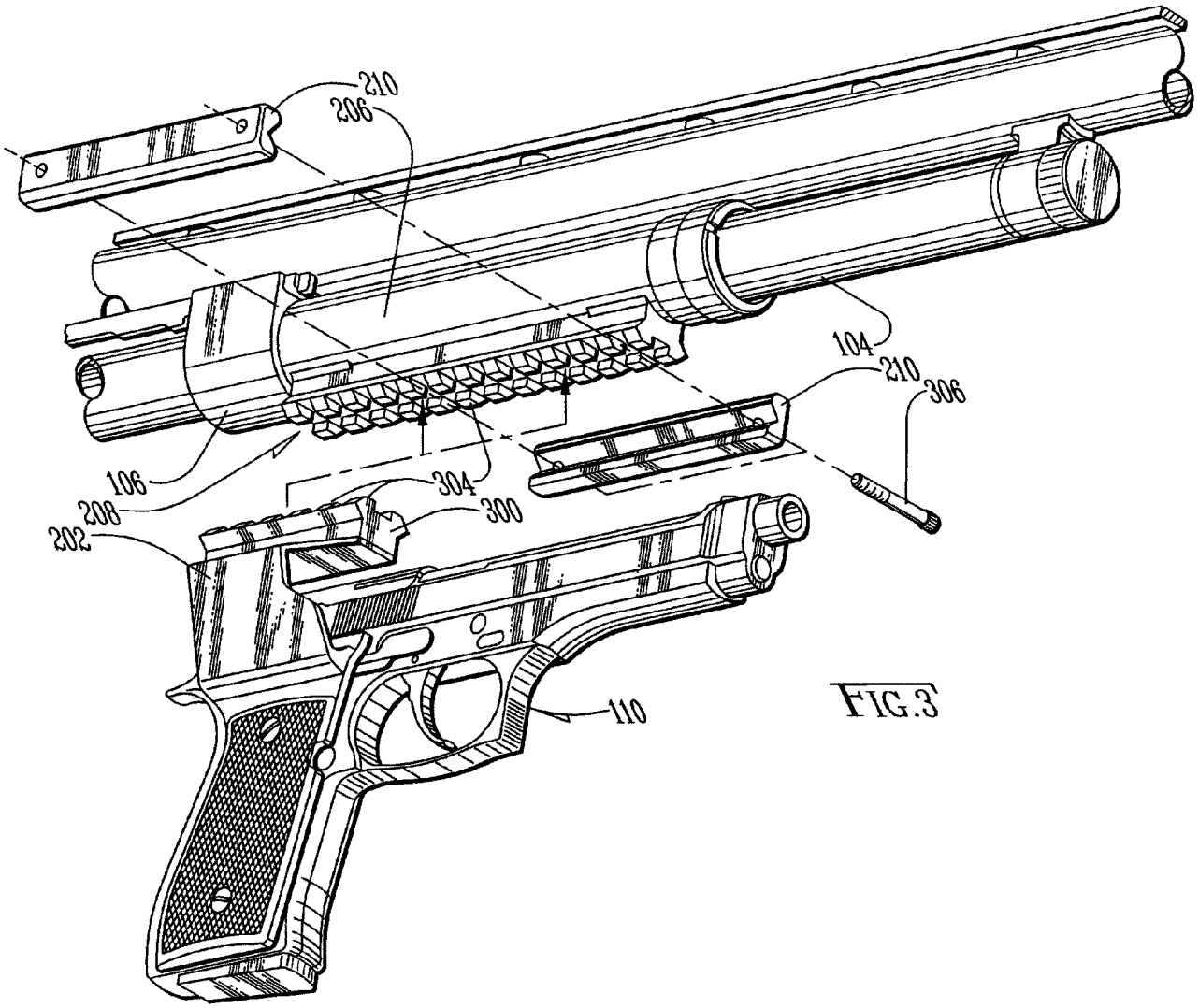
FIG. 3 is an exploded view of a portion of an embodiment of the handgun mount.

Referring now to FIG. 3, an exploded view of a portion of an embodiment of the handgun mount is depicted. The rail 300 attached to handgun bracket 202 is shown oriented for interlocking with rail 208. Rail 300 and handgun bracket 202 comprise an embodiment of the handgun mount assembly. Both rail 208 and rail 300 incorporate geometric features 304 that provide a secure engagement between the two rails. Various geometries may be utilized in the rails 208 and 300, and the type of geometry is not limiting of the scope of the claimed handgun mount system. In other embodiments of the handgun mount, slidably engaged rails may be utilized, or any other rail or connector geometry that provides a secure attachment between the forend tube assembly 106 and handgun 110.

Once rail 300 and rail 208 are engaged, brackets 210 are disposed on either side of the rails 300 and 208. In the embodiment, brackets 210 are shaped to engage rails 208 and 300 and prevent the separation of the two rails during use. Various geometries may be utilized in the brackets 210, and the geometry and or configuration thereof is not limiting of the scope of the claimed invention. In the embodiment shown in the figures, one or more tension screws 306 are provided to secure the brackets 210 on the side of the mounting rail 300, and through rail 208. Tightening of the tension screws 306 engages the brackets 210 on opposing sides of the mounting rails 208 and 300, squeezing the rails between the brackets 210 and securing the handgun bracket 202 to rail 208.

Figure 4:
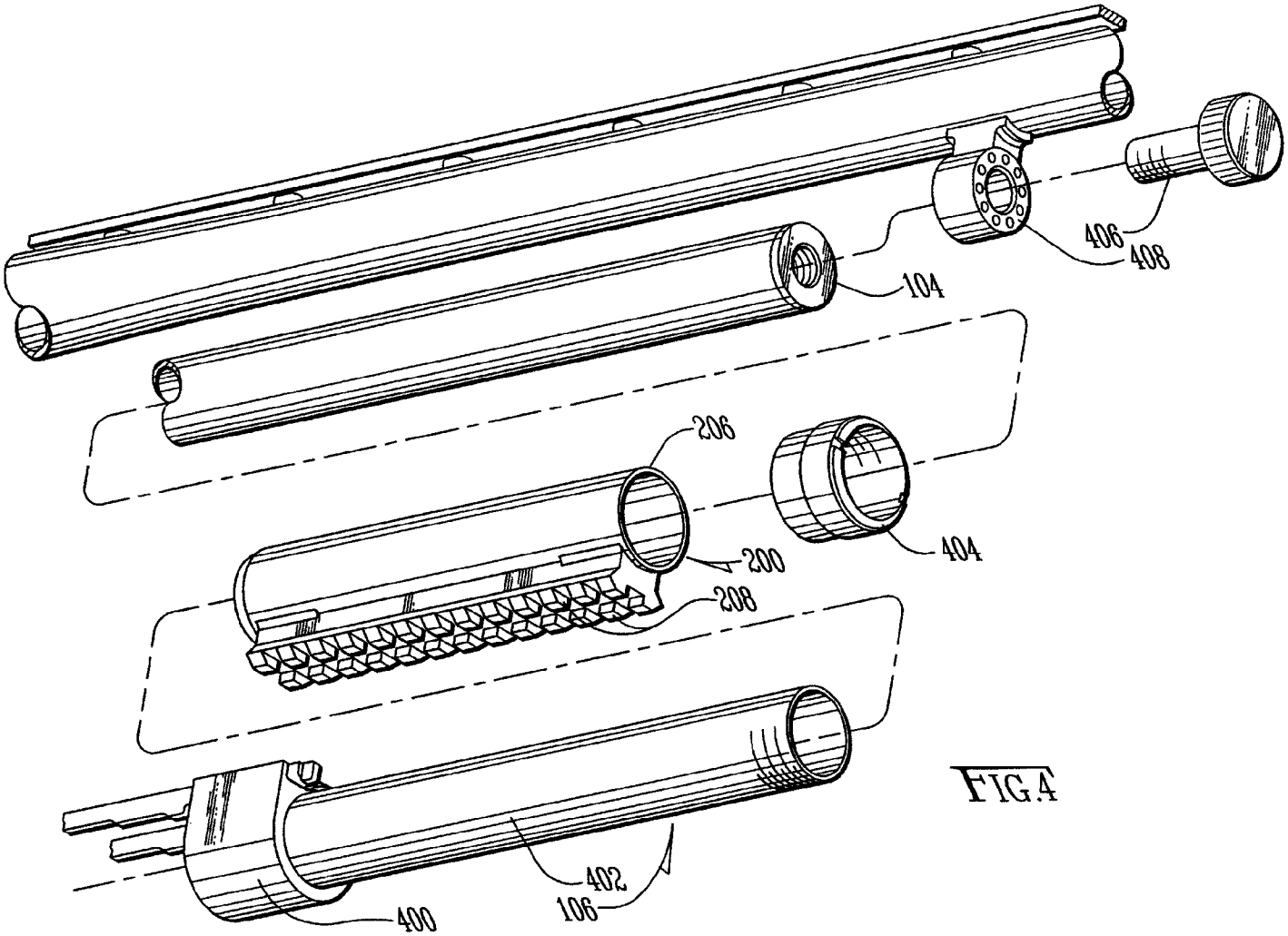
FIG. 4 is an exploded view of a portion of an embodiment of the handgun mount.

Referring now to FIG. 4, an exploded view of a portion of an embodiment of the handgun mount is depicted. Magazine tube 104 is shown removed from the barrel of the long gun under which it is disposed during operation. The forend assembly of the gun is comprised of engaging means 400 for actuating the action of the long gun in a pump action, and tube 402 for holding the grip for the user. A retaining nut 404 is also provided as part of forend assembly 106 for engaging threads on the end of tube 402 and retaining a grip in place on the forend assembly. The specific details of the forend assembly 106 may vary between various models of long gun on which the handgun mount is utilized, and are not limiting of the scope of the invention and claims.

Mount assembly 200 is placed on the forend assembly by removing retaining nut 404 and inserting tube 402 through tube 206 of assembly 200. Retaining nut 404 is then secured on tube 402, securing assembly 200 in its position. The tube 402 of forend assembly is disposed over magazine tube 104 and the tube 104 is disposed beneath the barrel of the long gun. Various means of securing tube 104 to the long gun may be provided, such as the mounting ring 408 and bolt 406 depicted in the figure.

Figure 5:
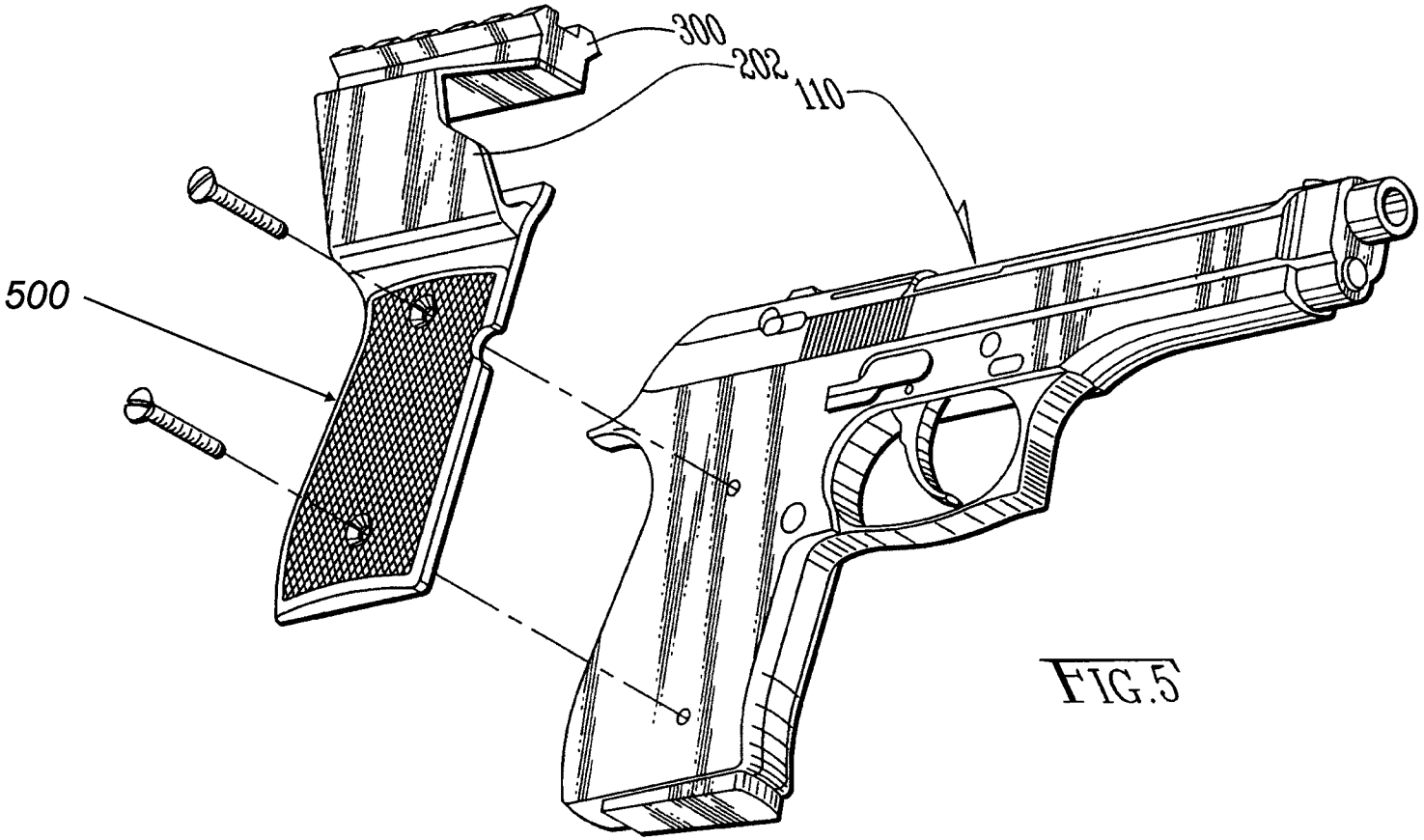
FIG. 5 is an exploded view of a portion of an embodiment of the handgun mount.

Referring now to FIG. 5, an exploded view of a portion of an embodiment of the handgun mount assembly is depicted. Handgun bracket 202 is shown attached to the grip of handgun 110 by means of a plurality of machine screws through the grip area of the handgun 110 and the bracket 202. Other means of attaching the bracket 202 to the handgun may be utilized to mount the handgun below rail 300 involving various configurations of brackets, arms, integral handgun mounting rail or other components, and may attach to the handgun in various areas other than the grip area thereof. The actual configuration of bracket 210 may also vary depending on the model of the handgun 110 and other considerations, so long as the handgun 110 is securely held below the rail 300. In the depicted embodiment a grip portion 500 is provided on one end of bracket 202 to attach to the side of the grip or handle of the handgun.

Referring now to FIG. 6, a cross-sectional view of a portion of an embodiment of the handgun mount is depicted. The cross-sectional plane of FIG. 6 is depicted on FIG. 2 as line 6-6 and lies perpendicular to the arrows depicted on the line. The plane extends along the length of tension screw 306. As tension screws 306 pull brackets 210 towards one another, the inner faces of the brackets contact with the angular faces of rails 208 and 300, causing them to be forced together. Other geometries of rail type attachment may be utilized in a similar manner and within the scope of the invention to securely attached bracket 202 to tube 206.

Figure 7:
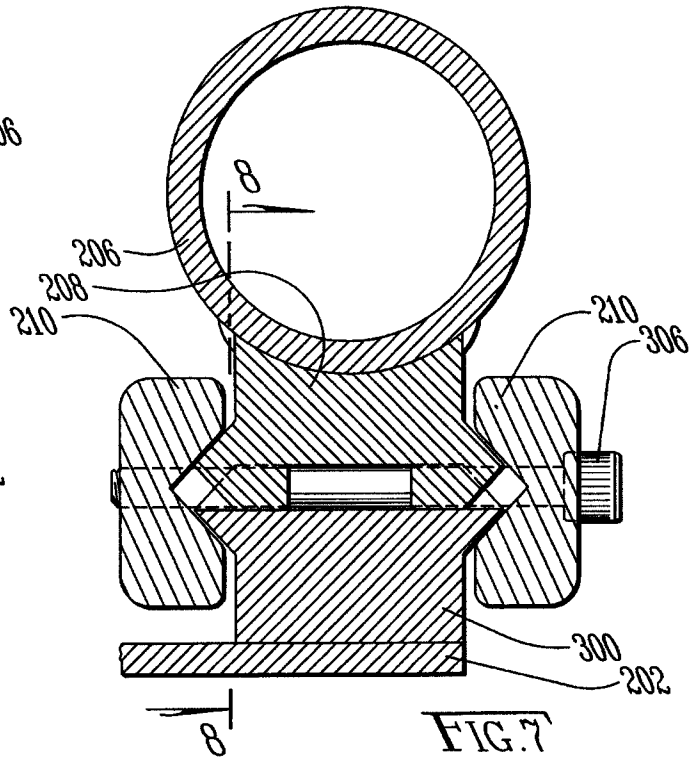
FIG. 7 is a cross-sectional view of a portion of an embodiment of the handgun mount.

Referring now to FIG. 7, a cross-sectional view of a portion of an embodiment of the handgun mount is depicted. The cross-sectional view depicted in this figure is in the same orientation as FIG. 6 and parallel to the cross-section plane thereof, but the cross-sectional plane is disposed between the two tension screws 306.

Figure 8:
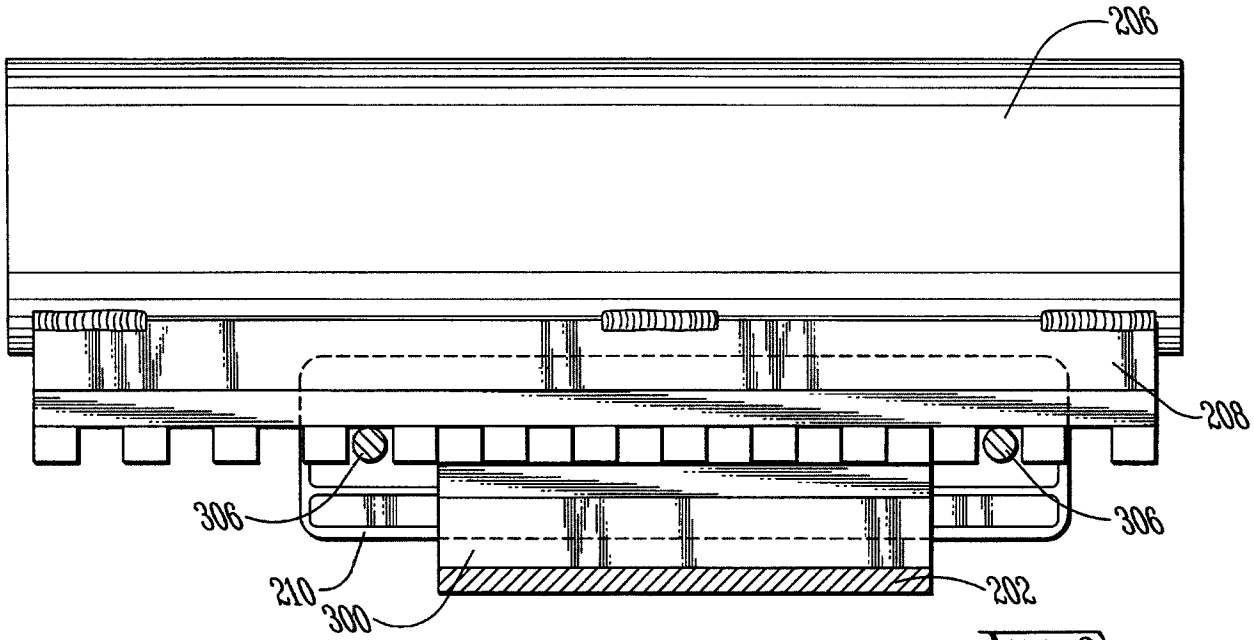
FIG. 8 is a side view of a portion of an embodiment of the handgun mount.
Figure 9:
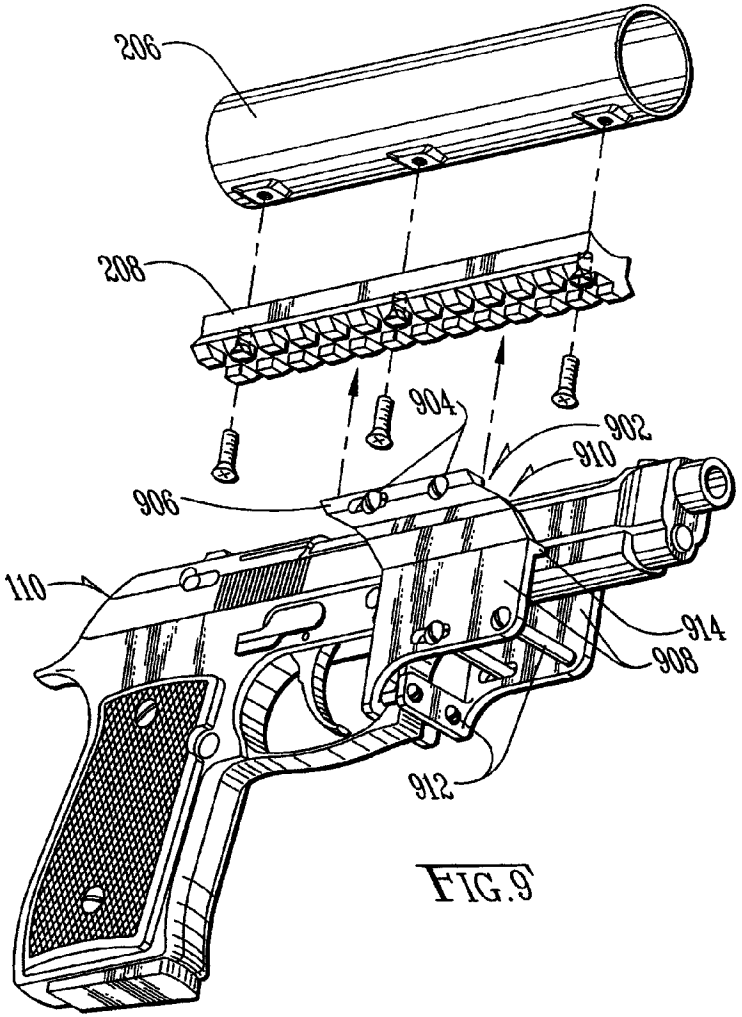

FIG. 8 is a side view of a portion of an embodiment of the handgun mount. A portion of FIG. 8 is a cross-sectional view through bracket 210, rails 208 and 300, and bracket 202. The cross-sectional plane of FIG. 8 is disposed along the line 8-8 in FIG. 7, and normal to the arrows on the line. The features 304 on rails 208 and 300 interlock as shown in FIG. 8, and prevent the rails from moving longitudinally along the tube 206 with respect to each other. Tension screws 306 are disposed to either side of rail 300 and extend between the features 304 in rail 208.

Figure 9:
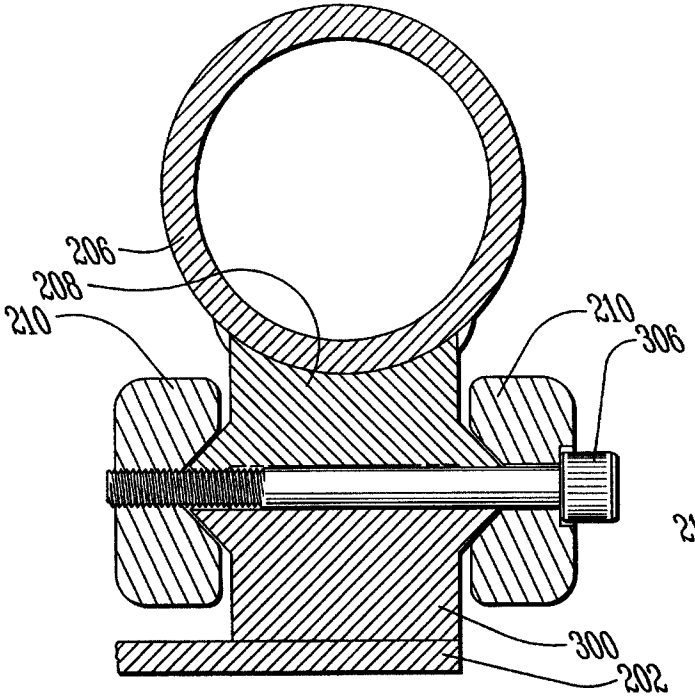
FIG. 9 is an exploded view of an alternative embodiment of a portion of the handgun mount.
Figure 10:
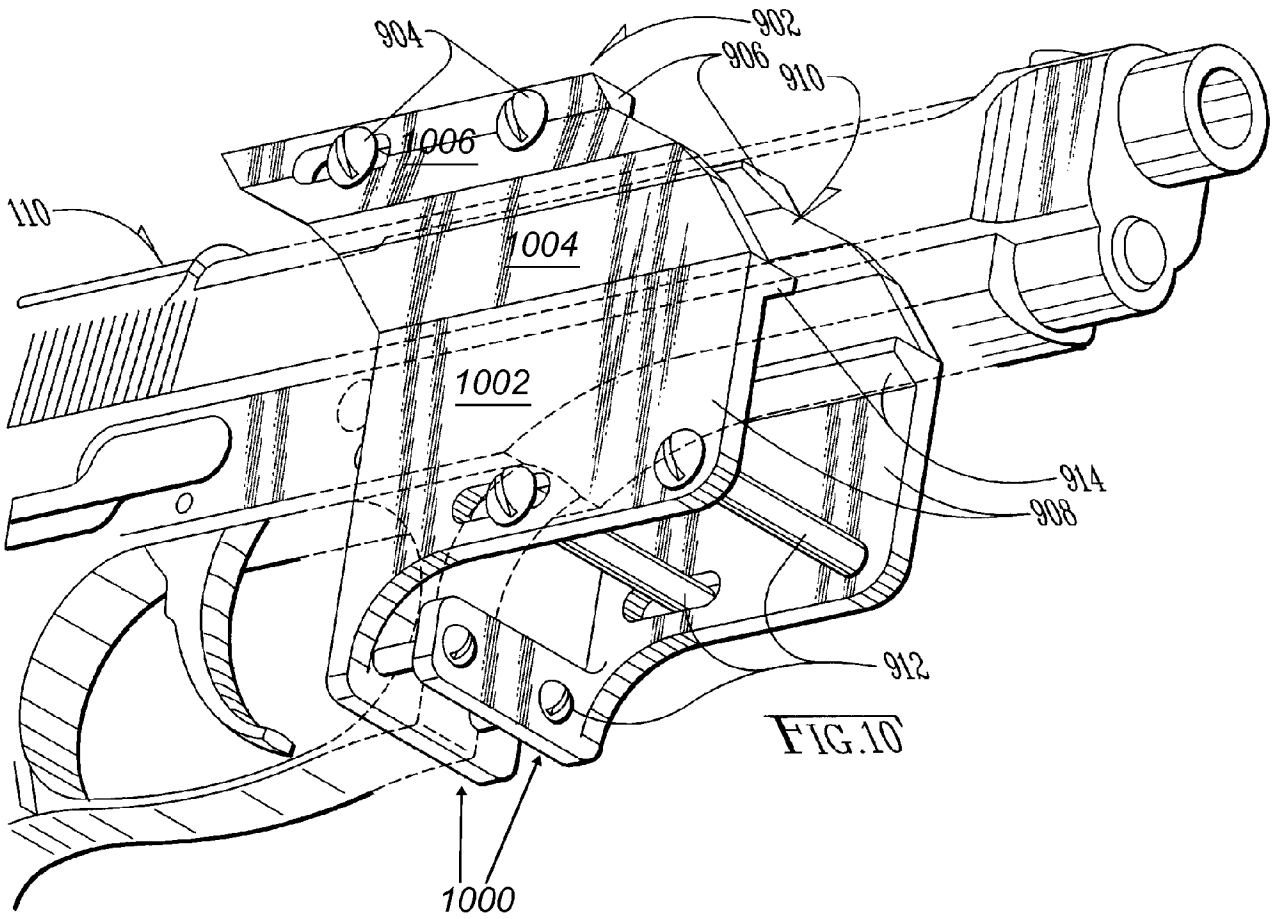
FIG. 10 is a detail perspective view of an alternative embodiment of a portion of the handgun mount.

Referring now to FIGS. 9 and 10, perspective views of an alternative embodiment of a portion of the handgun mount are depicted. An alternative method of attaching the rail 208 to tube 206 is depicted, comprising threaded lugs welded to the tube 206 for receiving bolts or screws inserted through holes in rail 208.

An alternative form of bracket 202 is also depicted. The alternative bracket comprises two plates 908 disposed on opposing sides of handgun 110. The handgun 110 is secured between the plates 908 by a variety of means as depicted in the figure. Clamping pressure exerted by screws or bolts 912 pulling the plates together assists in fixing gun 110 in place. A mounting plate may be provided for securing to the trigger guard of 110. Features on the plates such as ridge 914 may be provided to engage the features of the handgun 110, such as built in slide rails or other features of the handgun. The mounting plates 908 may be provided with tabs 1000 extending therefrom to engage the trigger guard of the handgun by clamping on either side thereof.

The embodiment of the handgun mount shown in FIGS. 9 and 10 does not incorporate a rail 300 or brackets 210. Rail engaging features 906 are provided on plates 908 for engaging rail 208. Screws or bolts 904 exert clamping pressure on features 906 causing them to secure the plates 908 and gun 110 to rail 208. In the embodiment shown in FIG. 10 each plate 908 comprises a lower receiver portion 1002, with a slide portion 1004 extending upwardly from the receiver portion 1002, and a clamp portion 1006 attached to the top edge of the slide portion 1004. The gun 110 is clamped between the receiver portions 1002 of the side plates 908.

Figure 11:
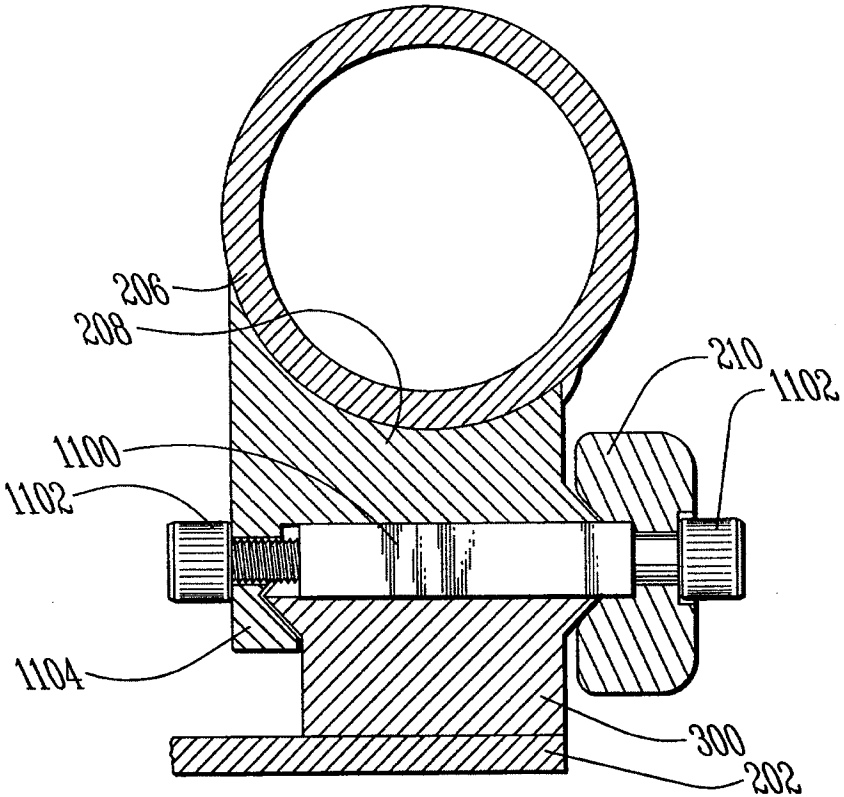
FIG. 11 is a cross-sectional view of a portion of an alternative embodiment of a portion of the handgun mount.

Referring now to FIG. 11, a cross-sectional view of a portion of an alternative embodiment of the handgun mount is depicted. The cross-sectional plane of FIG. 11 is depicted on FIG. 2 as line 6-6 and lies perpendicular to the arrows depicted on the line. The plane extends along the length of tension bolt 1100. In this embodiment, bolt 1100 has a square cross-section through a middle portion of the bolt 1100, and cylindrical threaded portions on the ends thereof. The portion of the bolt 1100 with the square cross-section engages square grooves disposed in rails 208 and 300. In this embodiment, rails 208 and 300 are not provided with geometric features 304, because the engagement of bolt 1100 in the grooves in the rails 208 and 300 securely hold the two rails in lateral position with respect to each other. The threaded portions of the bolt 1100 engaged nuts 1102 on either end, or alternatively rail 208 or bracket 210 may be threaded to receive the bolt 1100.

The embodiment of the rail shown in FIG. 11 utilizes only a single bracket 210 disposed on one side of rail 300 to engage and secure rail 300 to rail 208. The opposing edge of rail 208 extends downwardly as flange 1104 and is designed to engage one edge of rail 300. The bracket 210 engages the other edge of rail 300, and as bolt 1100 is tightened the bracket 210 clamps rail 300 against rail 208. The shape of rails 208 and 300 cause the tension on bolt 1100 to force rail 300 against rail 208 through its contact with the square portion of bolt 1100.

In some embodiments of the handgun mount, a laser sight is provided on the handgun mount or on the handgun for aiming the handgun during use. The long gun and attached handgun may be aimed individually during firing by using an integral or attached, optical or Laser site device(s) mounted on and sited to, each individual gun.

Figure 12:
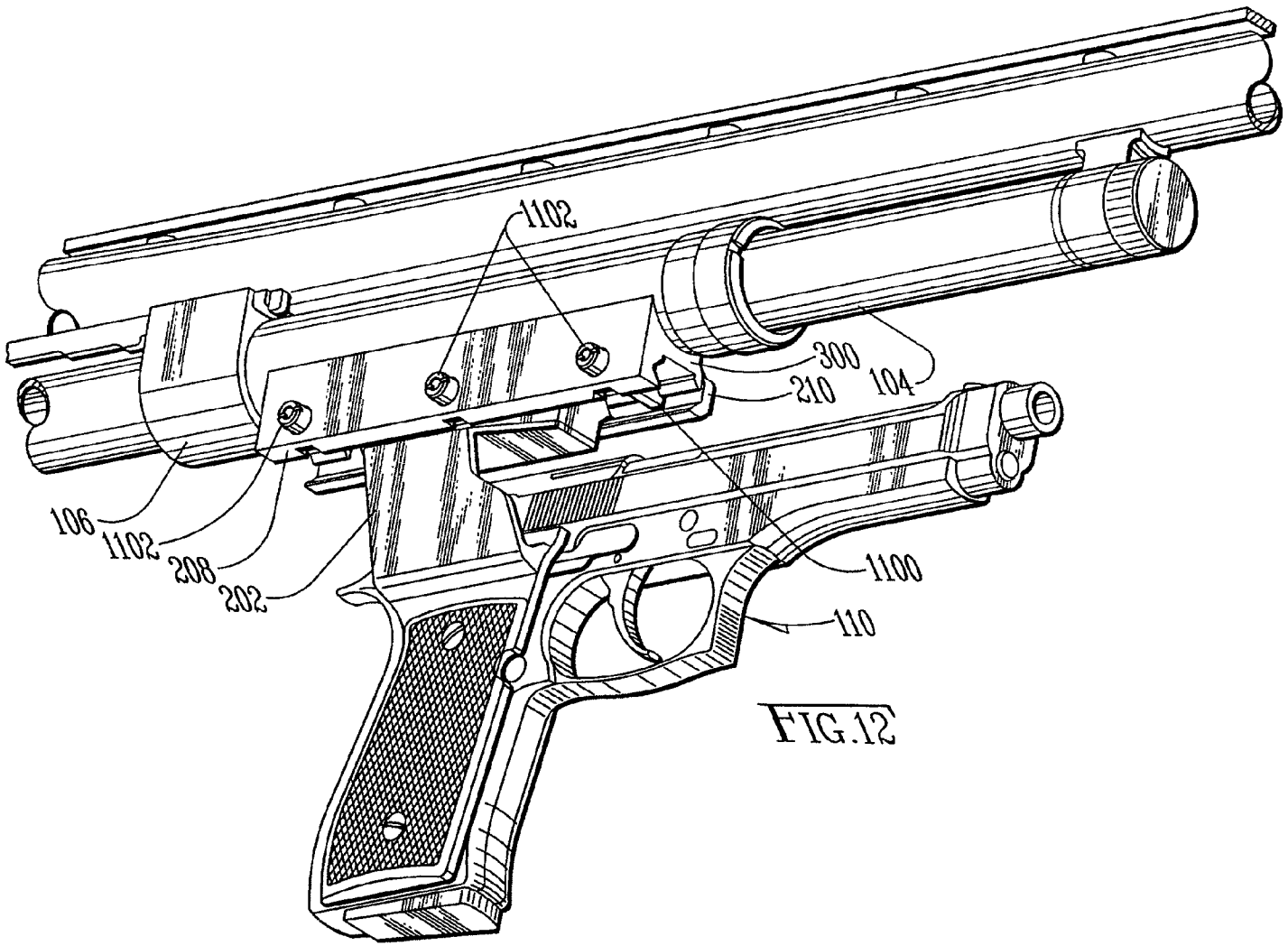
FIG. 12 is a perspective view of a portion of a long gun with an alternative embodiment of the handgun mount attached thereto.

Referring now to FIG. 12, a perspective view of a portion of a long gun with an alternative embodiment of the handgun mount attached thereto is depicted. The embodiment of the rail 208 depicted in FIG. 11 is shown attached to a long gun and with a handgun secured thereto.

Figure 13:
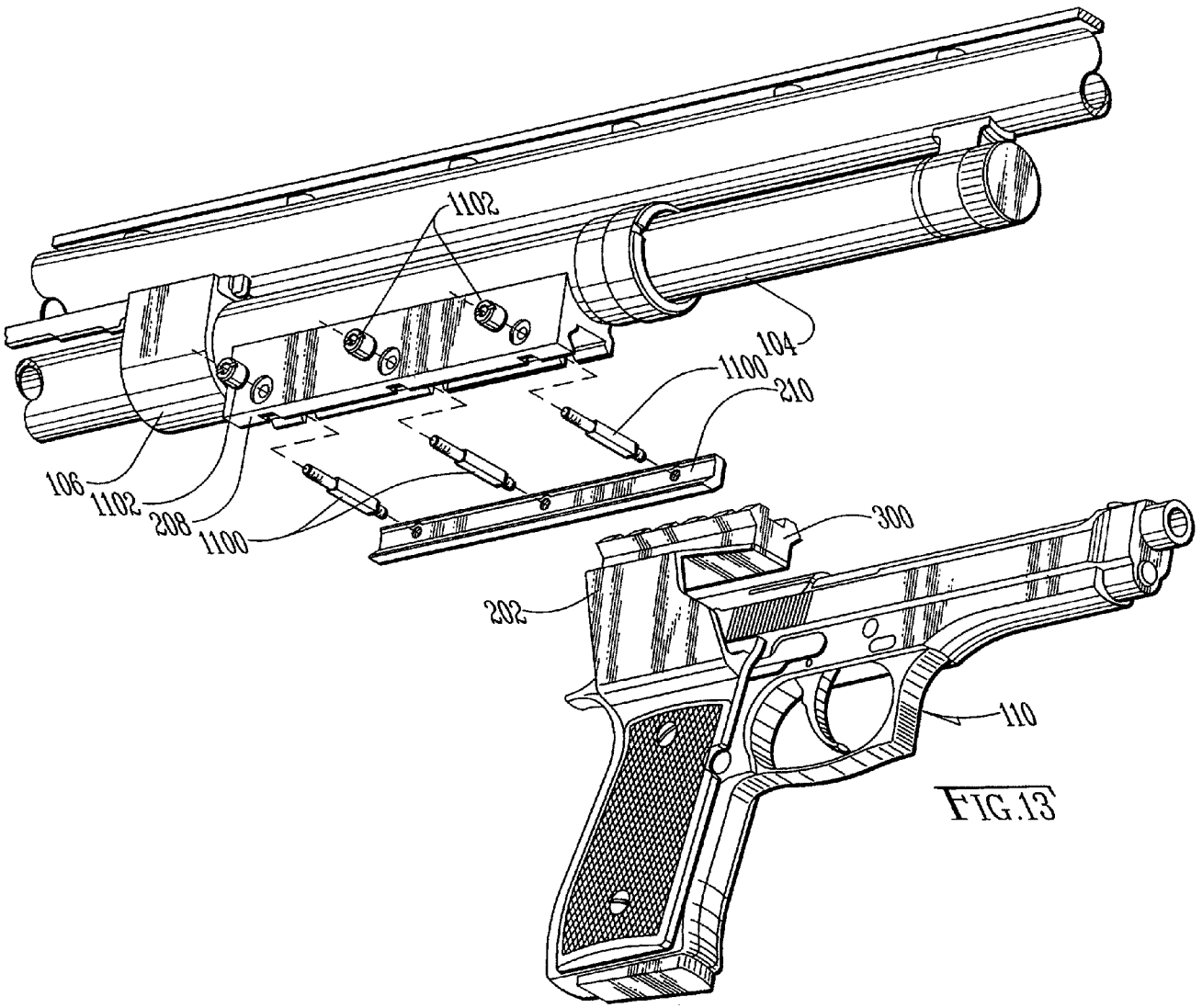
FIG. 13 is an exploded view of a portion of a long gun with an alternative embodiment of the handgun mount attached thereto.

Referring now to FIG. 13, an exploded view of a portion of a long gun with an alternative embodiment of the handgun mount attached thereto is depicted. In the embodiment depicted in FIG. 13, the rail 210 is threaded to receive the threaded portion of bolt 1100.

Figure 14:
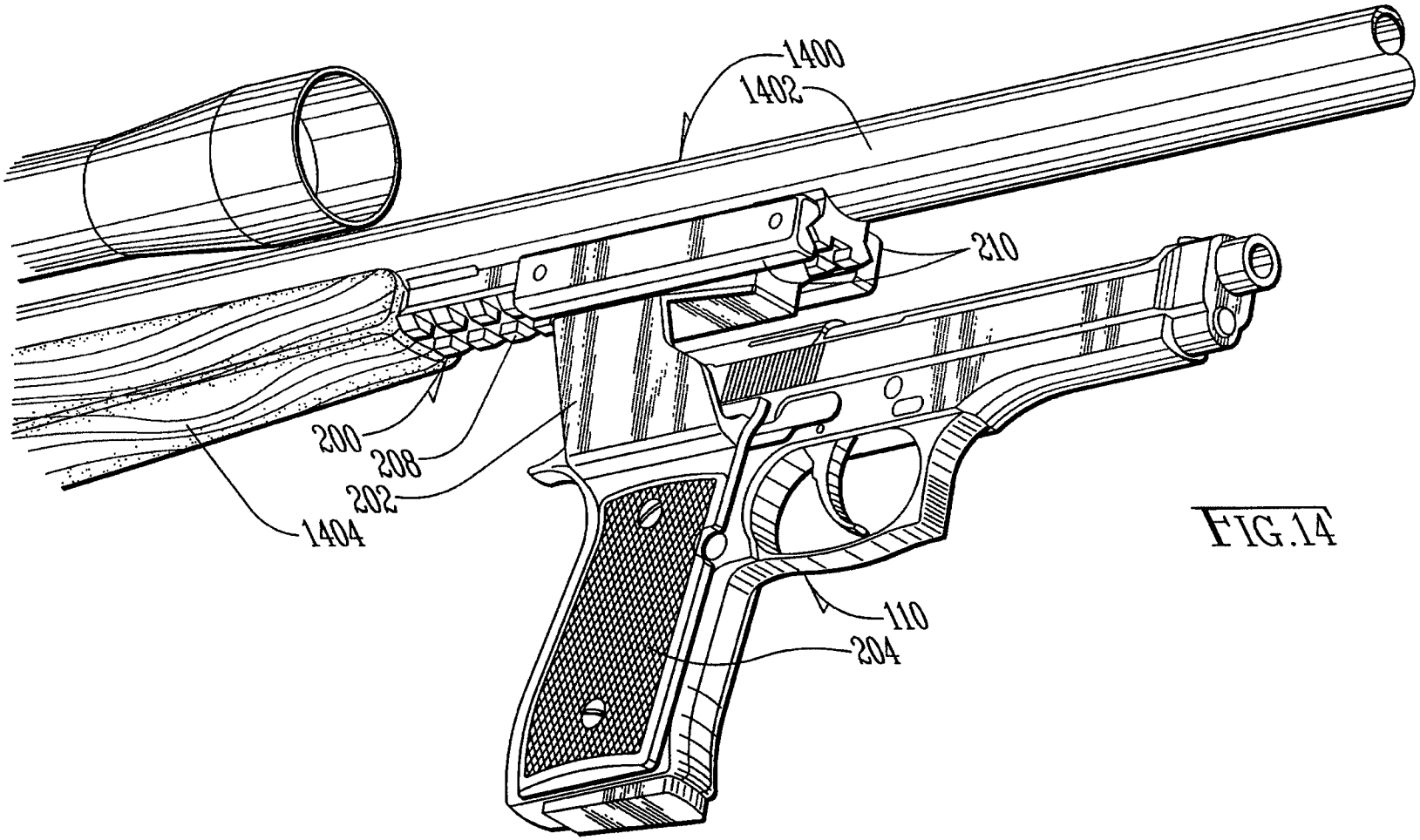
FIG. 14 is a perspective view of a portion of a long gun with an alternative embodiment of the handgun mount attached thereto.

Referring now to FIG. 14, a perspective view of a portion of a long gun with an alternative embodiment of the handgun mount attached thereto. In the embodiment shown in FIG. 14, the handgun mount is secured to the barrel of a rifle.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A handgun mount for mounting a handgun having a slide and a receiver to the forend of a long gun comprising a handgun bracket; said handgun bracket comprising a first and second plate disposed substantially parallel to each other, each plate having a first end and a second end, handgun clamping screws adjustably connecting the first and second plates adjacent to the first end of each of the first and second plates for clamping the receiver of the handgun between the first ends of the first and second plates, and rail clamping screws adjustably connecting the first and second plates adjacent to the second ends thereof for clamping the forend of the long gun above the slide and between the second ends of the first and second plates while the receiver of the handgun is clamped between the first ends of the first and second plates without clamping the slide of the handgun.

2. The handgun mount of claim 1 wherein the first and second plates each further comprise a tab extending substantially perpendicular therefrom for clamping a trigger guard of the handgun between said tabs.

3. The handgun mount of claim 2 wherein the tab extending from the first plate is disposed adjacent to an inside surface of the trigger guard and the tab extending from the second plate is disposed adjacent to an outside surface of the trigger guard, and the tabs are opposed to each other and releaseably clamped together.

4. The handgun mount of claim 3 wherein the tabs prevent longitudinal movement of the handgun between the first and second plates.

5. The handgun mount of claim 2 further comprising at least one feature extending from the first and second plates to engage a surface of the handgun.

6. The handgun mount of claim 1 wherein each of the side plates comprise a first receiver portion for clamping against the reciever of the handgun, a slide portion extending upwardly from the receiver portion, and a clamp portion attached to a top edge of the slide portion; wherein the slide portion does not exert clamping pressure against the slide of the handgun.

7. The handgun mount of claim 6, each side plate further comprising a tab extending from and perpendicular to the receiver portion of each side plate for engaging the receiver of a handgun for preventing longitudinal movement of a handgun.

* * * * *